US006986571B2

(12) United States Patent
Dudenhoefer et al.

(10) Patent No.: US 6,986,571 B2
(45) Date of Patent: Jan. 17, 2006

(54) FILTER FOR A PRINT CARTRIDGE

(75) Inventors: Christie Dudenhoefer, Corvallis, OR (US); Karl Stefan Weibezahn, Albany, OR (US); Gary J. Watts, Albany, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 258 days.

(21) Appl. No.: 10/128,397

(22) Filed: Apr. 23, 2002

(65) Prior Publication Data

US 2003/0197767 A1 Oct. 23, 2003

(51) Int. Cl.
*B41J 2/175* (2006.01)

(52) U.S. Cl. ..... 347/93; 347/86

(58) Field of Classification Search ..... 347/86, 347/93, 84, 85

See application file for complete search history.

(56) References Cited

U.S. PATENT DOCUMENTS 4,995,977 A * 2/1991 Hilgendorff et al. ... 210/321.69
5,610,645 A * 3/1997 Moore et al. ..... 347/93
5,657,065 A * 8/1997 Lin ..... 347/93
5,834,566 A * 11/1998 Helmer-Metzmann et al. ..... 525/535
6,007,176 A * 12/1999 Askren et al. ..... 347/18
6,086,195 A * 7/2000 Bohorquez et al. ..... 347/93
6,120,140 A * 9/2000 Hirosawa et al. ..... 347/93
6,199,979 B1 3/2001 Hobson et al.
6,234,622 B1 5/2001 Liu et al.
6,254,229 B1 7/2001 Bohorquez et al.
6,554,412 B1 * 4/2003 Seino et al. ..... 347/86
6,702,436 B2 * 3/2004 Haines et al. ..... 347/93

FOREIGN PATENT DOCUMENTS

DE 4000825 A1 * 5/1990
DE 4007383 A1 * 9/1991
JP 09295406 11/1997

* cited by examiner

*Primary Examiner*—Manish Shah
*Assistant Examiner*—Leonard Liang

(57) ABSTRACT

The present invention provides an ink filter for an inkjet print cartridge, the print cartridge having nozzles for dispensing ink from an ink supply. The filter is formed of a polymeric material and is configured to prevent particles in the ink supply from passing to the print nozzles. The polymeric filter material is overmolded in a carrier which is configured to be coupled between the ink supply and the print nozzles.

21 Claims, 3 Drawing Sheets

FILTER FOR A PRINT CARTRIDGE

TECHNICAL FIELD

The present invention relates generally to printers, and more specifically, to print cartridges for printers. Even more specifically, the present invention relates to a filter for a print cartridge.

BACKGROUND ART

Inkjet printers print by ejecting ink through the nozzles of a print cartridge onto a print medium. An ink supply, which may be contained within the cartridge or located remotely, serves to supply ink to the nozzles. Because the nozzles typically have relatively small flow areas, particulate matter can clog the nozzles, disrupting or reducing printing performance. Surfaces that are exposed to the ink, such as those within the cartridge or separate ink supply, are common sources of disruptive particulate matter.

In the past, woven metal filters have been inserted between the ink supply and the print cartridge nozzles to prevent any particles from reaching the nozzles. Unfortunately, the woven metal filters themselves may be susceptible to carrying and releasing particulate matter that can clog the nozzles. Furthermore, the use of woven metal filters may reduce the types of inks that can be used because some desirable inks are highly corrosive to the woven metal filters. Moreover, many past filters have had less than desirable filtration efficiencies within certain pressure drop ranges.

Therefore, there is a need for a filter having high filtration efficiency at a wide range of pressure drops. In addition, there is a need for a clean filter that can withstand highly corrosive chemicals.

SUMMARY OF THE INVENTION

The present invention provides a filter for an inkjet print cartridge, the print cartridge having nozzles for dispensing ink from an ink supply. The filter is formed of a polymeric material and is configured to prevent particulates in the ink supply or print cartridge from passing to the print nozzles. The polymeric filter material is overmolded in a carrier which is configured to be inserted into a print cartridge between the ink supply and the nozzles.

DETAILED DESCRIPTION OF THE PREFERRED EMBODIMENT AND BEST MODE OF CARRYING OUT THE INVENTION

The present invention provides a polymeric filter for use in a printer. The polymeric filter is placed in the ink flow path of an inkjet printer and may be used, for example, to reduce or eliminate particulate matter in ink used for mechanical printing.

Figure 1:
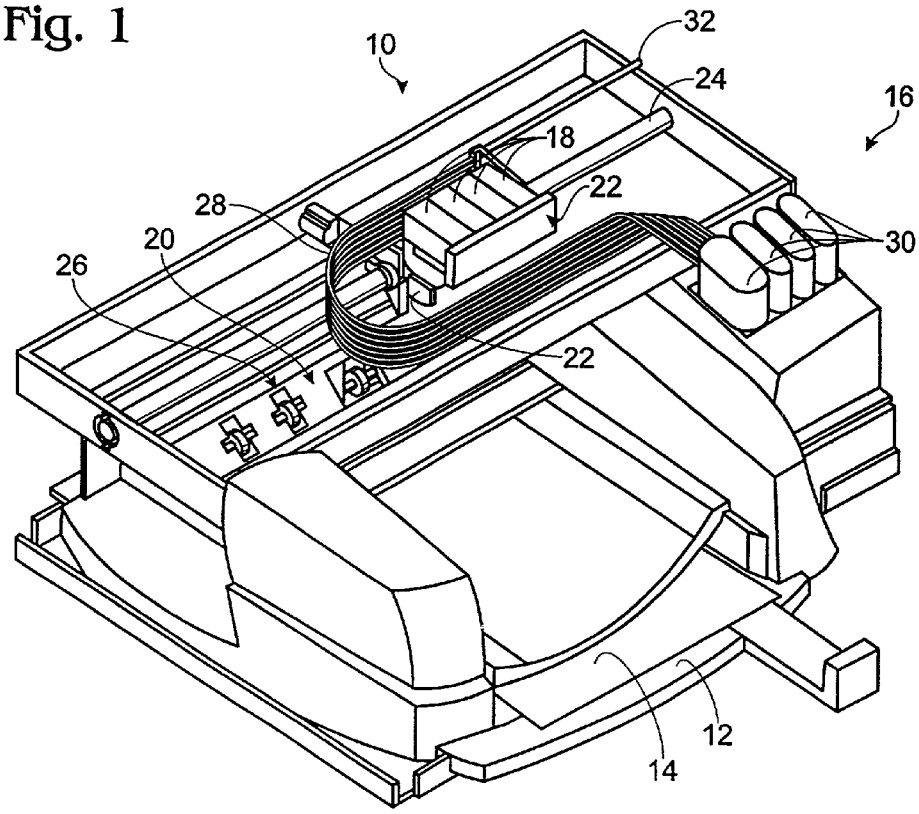
FIG. 1 is an isometric view of an exemplary printer suitable for use in implementing a printing system in accordance with one embodiment of the present invention.

FIG. 1 depicts an exemplary printer 10 suitable for use in implementing a printing system in accordance with one embodiment of the present invention. As shown, printer 10 includes a tray 12 for holding print media 14, which may be, for example, a sheet of paper. Printer 10 further includes an ink supply 16, including one or more ink containers 30, which provide ink to one or more print cartridges 18, for example, via a flexible conduit 28. Alternatively, each of print cartridges 18 may utilize one or more onboard ink reservoirs (not shown) rather than the remote ink containers shown at 30. It will be appreciated that these onboard ink reservoirs may be refilled with ink so as to enable extended use of the print cartridges. Furthermore, print cartridges 18 may be permanently or removably mounted to carriage 22.

Carriage 22 may be of any conventional type, and may employ a coded strip 32, which may be optically detected by a photodetector (not shown) in carriage 22 for precise positioning of the carriage. The carriage may be moved using a stepper motor (not shown), which may be connected to carriage 22 by a drive belt, screw drive, or other suitable mechanism.

When a printing operation is initiated, print media 14 is fed into the printing area 20 of printer 10. Once print media 14 is properly positioned, carriage 22 may traverse the print media, for example on slide rod 24, such that the one or more print cartridges may eject ink onto the print media in the proper position. Print media 14 then may be moved incrementally, for example by a conventional stepper motor and feed rollers 26, so that carriage 22 again may traverse the print media, allowing the one or more print cartridges to eject ink onto a new position on the print media. This process may be repeated until the printing operation is complete, at which point the print media may be removed from printing area 20.

Figure 2:
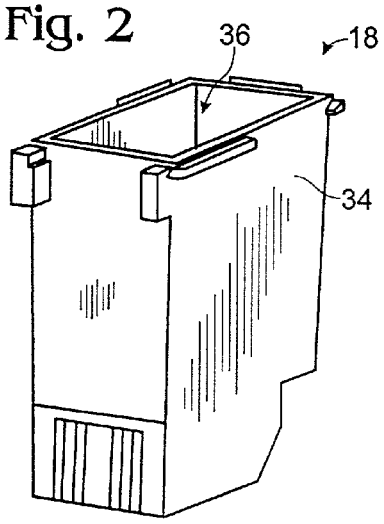
FIG. 2 is an isometric view of print cartridge suitable for use in implementing a printing system in accordance with one embodiment of the present invention.
Figure 3:
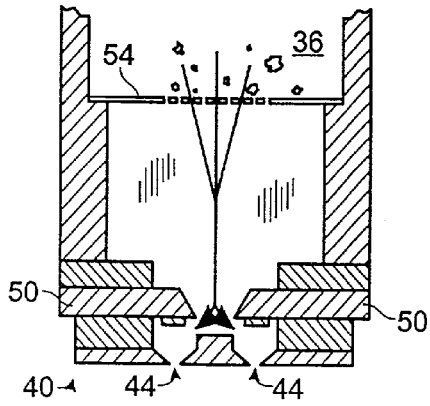
FIG. 3 depicts a schematic cross-section of a print cartridge incorporating a filter according to one embodiment of the present invention.

FIG. 2 shows the exterior of an exemplary print cartridge 18. As shown, print cartridge 18 includes a body 34, which forms an ink chamber 36. A schematic cross-section of print cartridge 18 is shown in FIG. 3. As shown, ink chamber 36 typically terminates in one or more nozzles 44 in printhead assembly 40 of the cartridge 18. Nozzles 44 are shown downstream of substrate 50. In some embodiments, the print cartridge may contain plural rows of offset nozzles, although such an arrangement is not shown, for simplicity.

Upon initiation of a printing operation, a signal may be produced from, for example, an electrical connection between print cartridge 18 and printer 10. The signal may be sent to a series of ink ejection elements (not shown) and a thin layer of ink within ink chamber 36 may be superheated to provide explosive vaporization and, consequently, cause a droplet of ink to be ejected through nozzles 44. Other ink ejection mechanisms may also be employed, such as piezoelectric print mechanisms. This process enables selective deposition of ink on print media 14 to generate text and images. However, since the print cartridge nozzles have relatively small flow areas, the nozzles 44 are susceptible to clogging from contaminant particles from the ink supply and ink cartridge surfaces. This compromises the printing process and limits high throughput printing.

To prevent clogging, a filter element 54 may be placed in the ink flow path between the ink supply and the print nozzles. The filter may be adapted to prevent particulate matter from reaching and clogging the print cartridge nozzles.

Filter element 54 is preferably housed within a filter carrier 56, which fits inside the print cartridge body 34. The filter carrier serves to provide additional structure for the filter material and to create a strong seal between the filter and the cartridge body such that any ink within the print cartridge must pass through the filter before it is delivered to nozzles 44.

In this embodiment, the filter assembly, including the filter element and the filter carrier, is press-fit into the print cartridge body, making a seal between the carrier and the print cartridge body walls due to an interference fit between a sealing feature 60 on the carrier and the inside of print cartridge 18, as discussed below.

Figure 4:
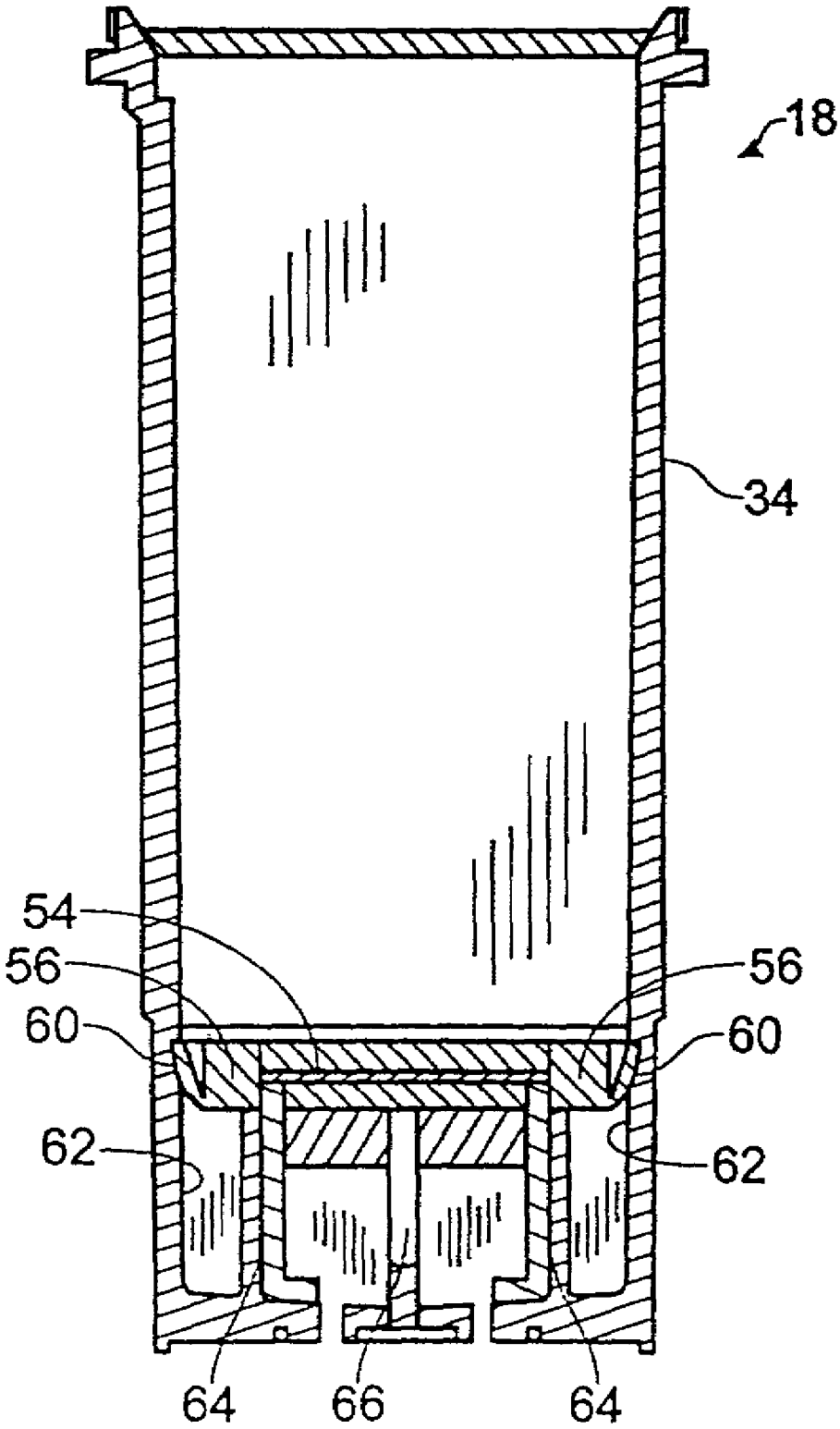
FIG. 4 is a cross-sectional view of a print cartridge such as that shown in FIG. 2 incorporating a filter and filter carrier according to one embodiment of the present invention.

As shown in FIG. 4, filter carrier 56 may be over-molded or insert molded around filter element 54. As shown, in this embodiment, filter carrier 56 may include a carrier lip 60 that flexes inwards after contacting the wall 62 of cartridge body 34 to form a seal. In this configuration, filter carrier 56 may rest on landings 64. Standpipe 66 may be open, as shown in this figure, or may provide a trough-like feature for the ink to flow through (not shown).

Figure 5:
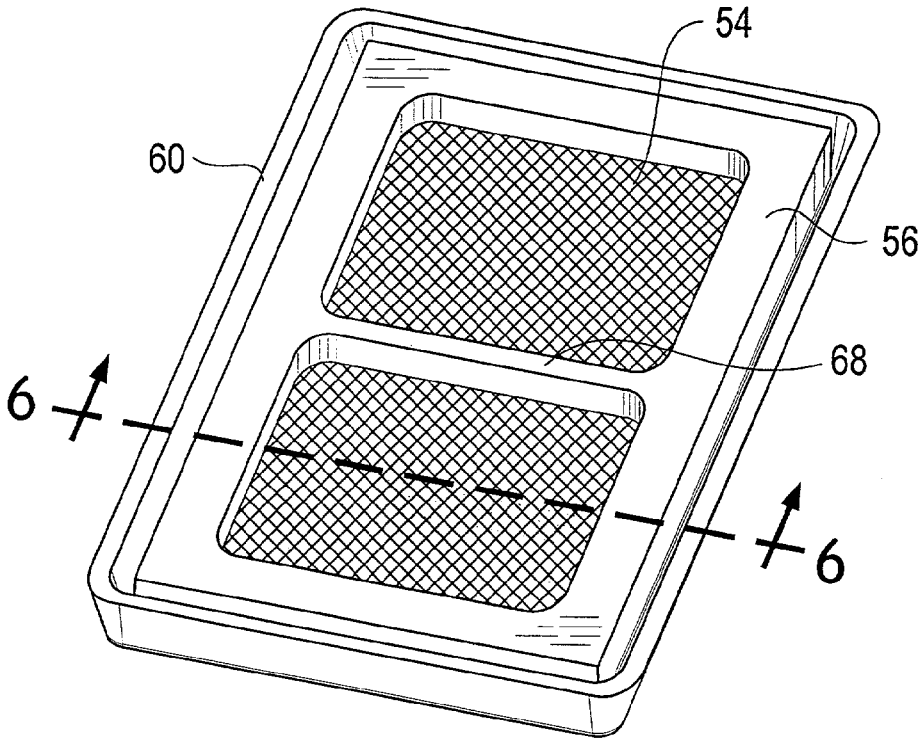
FIG. 5 is an isometric view of an exemplary filter and filter carrier according to the present invention.
Figure 6:
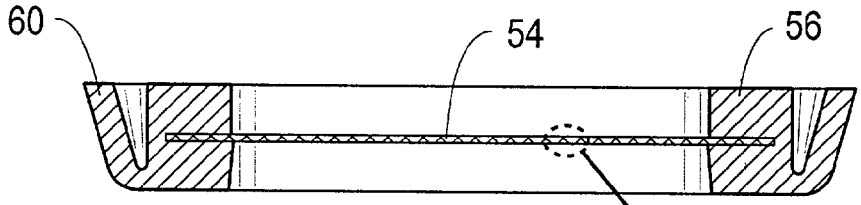
FIG. 6 is a cross-sectional view of an exemplary filter and filter carrier according to the present invention along line 6—6 of FIG. 5.
Figure 7:
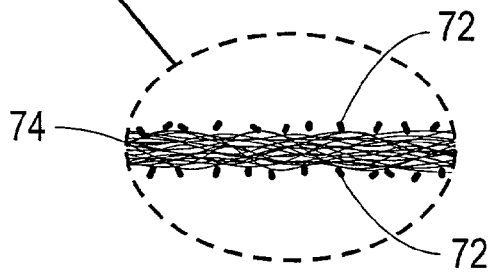
FIG. 7 is an enlarged cross-sectional view of the filter member according to the present invention.

FIGS. 5, 6, and 7 further illustrate an exemplary embodiment of the filter of the present invention. FIG. 5 is an isometric view of the filter and filter carrier; FIG. 6 is a cross-sectional view of the filter and filter carrier along line 6—6 of FIG. 5; and FIG. 7 is an enlarged cross-sectional view of the filter element. As shown in FIG. 5, filter carrier 56 preferably includes a resilient lip 60 to retain the carrier in the print cartridge, and may include one or more stiffening and reinforcing members 68. Although depicted as rectangular, the filter carrier may be other shapes, such as round.

As shown in FIG. 6, the carrier 56 is preferably over-molded over the filter element 54. The carrier material should be chemically stable to withstand prolonged exposure to inkjet inks. The material should also be resistant to deformation when exposed to high temperatures, such as might be present during the assembly of the cartridge, and should retain its strength and resilience. A preferred material for the carrier is a polyetherimide (PEI) resin material, such as made by General Electric Plastics under the trade name Ultem® 1010. The carrier preferably includes a resilient lip 60 which forms a tight seal when installed in the cartridge to prevent ink from flowing around, rather than through, the filter.

FIG. 7 is an enlarged cross-sectional view of the filter element 54. The filter element preferably comprises a primary filter material 74, such as discussed below, and a backing layer 72 to provide structure and support for the filter. The backing layer may be on one side of the filter material or on both sides of the filter material; with some filter materials, a backing layer may be unnecessary. The backing layer may be a lightweight plastic such as polypropylene or any other suitable material. As will be appreciated, if a backing material is used, the backing material should have the same or higher tolerance for the corrosive effects of the ink composition being used as the primary filter material, as described in detail below.

The primary filter material 74 of the present invention is preferably a polymeric material. For the purposes of the present discussion, a polymeric material is a material made of a chemical compound having a high molecular weight and including a number of structural units linked together by covalent bonds. The simple molecules that may become structural units are themselves called monomers. A structural unit is a group of monomers having two or more bonding sites. In a linear polymer, the monomers are connected in a chain arrangement and thus need only have two bonding sites. When the monomers have three bonding sites, a nonlinear, or branched, polymer results. (See, *The Concise Columbia Encyclopedia,* Columbia University Press (1995).

The use of a suitable polymeric material provides the filter with increased filtration efficiency and higher tolerance for the corrosive effects of certain ink compositions than previously described woven metal filters. Examples of suitable polymeric materials are polysulfone (PSU) and polytetrafluoroethylene (PTFE). A preferred material is an alloy of polysulfone and polyvinylpyrrolidone (PVP), such as produced by Filterite.

Filters may be assessed under a number of criteria related to the filters' performance and ability to withstand various conditions. In combination, these criteria can be used to define which filter is suitable for a particular use. These characteristics include incoming part cleanliness, filtration efficiency, pressure drop, chemical robustness, thermal robustness, and thickness, each of which is described in further detail below.

In general, incoming part cleanliness, filtration efficiency, pressure drop and chemical robustness are the more important criteria in determining a filter's ability to perform. Thermal robustness and thickness tend to be dependant upon the particular system being used and may be modified for any given system. Accordingly, when comparing various filter materials, a filter that exhibits superior performance in incoming part cleanliness, filtration efficiency, pressure drop and/or chemical robustness may prove to be more suitable for use even if it exhibits inferior performance in thermal robustness.

Typically, "incoming part cleanliness" (IPC) is the number of particles of a given size that are given off or "shed" by a square centimeter of the filter during use. For the purposes of the present invention, the IPC of the filter is established by determining the number of 6 um and larger particles that are shed by the filter after exposure to liquid. The IPC may be determined by flushing the filter with a clean isopropyl alcohol solution, collecting the elutant and conducting a particle count on the collected elutant using a liquid particle counter. These particles may have been picked up by the filter during manufacture or handling prior to use. Typical woven metal filters have an approximate IPC of less than 300 shed particles. Filters of the present invention should have an IPC of less than 100 shed particles, preferably less than 75 shed particles, and more preferably less than 50 shed particles.

The "filtration efficiency" (FE) of a filter is established by determining the percentage of particles of a given size that are removed from the ink by the filter at a given flow rate. For the purposes of the present invention, the FE of the filter is established by determining the percentage of 6 um and larger particles that are removed by the filter at flow rates of between 0 and 10 ml/min. Typical woven metal filters have a FE of approximately 75%. Filters of the present invention should have an FE of greater than 98%, preferably greater than 99%, and more preferably greater than 99.5%.

The "pressure drop" (PD) of a filter is determined by measuring the difference in pressure on either side of the filter as a fluid is pushed through the filter. The PD may be dependant upon several factors including the flow rate of the fluid, the viscosity of the fluid, and the area of the filter. For the purposes discussion, the PD referred to herein is the pressure loss through one square centimeter of filter at a flow rate of 5 ml/min of Isopropyl alcohol. Typical woven metal filters have a PD of approximately 1" $H_2O$. Filters of the present invention may have a pressure drop of between less than 1.5" $H_2O$, preferably less than 1" $H_2O$, and most preferably less than 0.5" $H_2O$.

The "chemical robustness" (CR) of a filter is established by determining whether the filter retains all the physical properties and continues to meet specifications after prolonged exposure to ink. Furthermore, the filter should not leach substances into the ink that change the properties of the ink. In short, the filters of the present invention are typically chemically inert when subjected to the hostile conditions in the print cartridge created by the ink. As will be appreciated, a filter that is able to withstand a wider range of conditions is greatly desired as it enables the use of a wider range of ink compositions.

For the purposes of the present discussion, the term "corrosive" is used to describe ink materials that are capable of chemically degrading various components typically encountered in conventional ink delivery systems (especially plastic parts). Corrosive agents in the ink formulations may include one or more organic solvents, which are employed as ink vehicles or humectants, as well as reactive components and other compounds (depending on the ink products under consideration.)

Various ink compositions and their components are described in, for example, commonly assigned U.S. Pat. No. 6,196,669 to Harvey et al. The polymeric filters of the present invention are typically inert when subjected to the ink compositions described in U.S. Pat. No. 6,196,669, even for prolonged periods of time.

The exemplary ink compositions described in U.S. Pat. No. 6,196,669 typically contain at least one coloring agent. This coloring agent may be either a black or color dye. Exemplary black dyes are listed in U.S. Pat. No. 4,963,189 to Hindagolla. Multiple color dye materials are described in the Color Index, Vol. 4, 3rd ed., published by The Society of Dyers and Colourists, Yorkshire, England (1971). As used in U.S. Pat. No. 6,196,669, the term "coloring agent" encompasses pigment dispersions that involve a water-insoluble colorant (namely, a pigment) that is rendered soluble through association with a dispersant (e.g. an acrylic compound). Those of skill in the art will know specific pigments that may be employed to produce pigment dispersions. Typically, the ink compositions of interest will contain about 2–7% by weight total coloring agent therein (e.g. whether a single coloring agent or combined coloring agents are used). However, the amount of coloring agent to be employed may be varied as needed, depending on the ultimate purpose for which the ink composition is intended and the other ingredients in the ink.

The exemplary ink compositions described in U.S. Pat. No. 6,196,669 also may include an ink vehicle. The ink vehicle functions as a carrier medium and main solvent for the other ink ingredients. Many different materials may be used as the ink vehicle, and the present invention is not limited to any particular products for this purpose. A typical ink vehicle may include water combined with other components including organic solvents. These organic solvents may include, but are not limited to, 2-pyrrolidone, 1,5-pentanediol, N-methyl pyrrolidone, 2-propanol, ethoxylated glycerol, 2-ethyl-2-hydroxymethyl-1,3-propanediol, cyclohexanol, and/or other materials known in the art for solvent and/or humectant purposes. Such materials are volatile and may be corrosive as defined above. These compounds may be used in various combinations. Typically, the ink formulations will contain about 70–80% by weight total combined ink vehicle.

The exemplary ink compositions described in U.S. Pat. No. 6,196,669 may also include a number of optional ingredients in varying amounts. For example, an optional biocide may be added to prevent any microbial growth in the final ink product. Exemplary biocides suitable for this purpose include proprietary products sold under the trademarks PROXEL GXL by Imperial Chemical Industries of Manchester, England; UCARCID by Union Carbide of Danbury, Conn. (USA); and NUOSEPT by Huls America, Inc. of Piscataway, N.J. (USA). If a biocide is used, the final ink composition will typically include about 0.05–0.5% by weight biocide, with about 0.30% by weight being typical.

Another optional ingredient described in U.S. Pat. No. 6,196,669 may involve one or more buffering agents. The use of a selected buffering agent or multiple (combined) buffering agents is intended to stabilize the pH of the ink formulations, if needed or desired. The optimum pH of the ink compositions may range from approximately 4–9.5. Exemplary buffering agents suitable for this purpose include sodium borate, boric acid, and phosphate buffering materials known in the art for pH control. The selection of any particular buffering agents, and the amount of buffering agents to be used (as well as the decision to use buffering agents in general), may be made in accordance with preliminary pilot studies on the particular ink compositions of concern. Additional ingredients (e.g. surfactants) may also be present in the ink compositions, if needed or desired.

Polymeric filters of the present invention are generally resistant to the corrosive effects of ink and are able to maintain structural integrity and resist chemical deterioration from ink for at least 5 years. Thus, filter 54 may be used in printing systems that utilize ink materials that contain volatile and/or corrosive components including reactive dyes and organic solvents. Moreover, because the polymeric filter of the present invention has a higher tolerance for the corrosive effects of ink than the previously-described woven metal filters, many different ink formulations may be used in connection with the present invention, thus allowing for the manufacture of a single filter type for use in a wide variety of printing applications.

For the purposes of the present invention, the "thermal robustness" (TR) of the filter is established by determining whether the filter retains all the physical properties and continues to meet the above specifications after exposure to the high temperatures required during processing. Filters of the present invention generally retain thermal robustness at or below 80° C., preferably at or below 90° C., and more preferably at or below 100° C.

For the purposes of the present invention, the "thickness" refers to the thickness of the filter media and any required backer materials, shown in FIG. 7. As will be understood, the thickness may be dependent upon the design of the print cartridge in which the filter is used. Thus, without wishing to be limited, a typical filter of the present invention will have a thickness of less than 0.030", preferably less than 0.020", and more preferably less than 0.010", however filters having a thickness well outside of this range are contemplated by the present invention.

Due to its high level of incoming part cleanliness, increased filtration efficiency, reduced pressure drop, and increased chemical robustness, the polymeric filter of the present invention is capable not only of filtering particles from the ink flow, but also of surviving a variety of hostile conditions created within the ink cartridge. As will be appreciated, these conditions can change depending on the specific ink composition used. Thus, the present invention provides a filter capable of withstanding a wide range of conditions obviating or reducing the need to manufacture and use different filters for different ink compositions.

Accordingly, while the present invention has been shown and described with reference to the foregoing preferred embodiments, it will be apparent to those skilled in the art that other changes in form and detail may be made therein without departing from the spirit and scope of the invention as defined in the appended claims. For example, while many of the features of the present invention have been described by reference to figures and descriptions suitable for ink jet printers and their associated cartridges, the filter of the present invention is suitable for any printing system in which it is desirable to filter particulate matter in the ink supply. Thus additional printers and print cartridges are contemplated by the present invention.

The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements. It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the inventions of the present disclosure.

We claim:

1. An ink filter for an inkjet cartridge, comprising:

a filter element formed of a polymeric material configured to prevent particles in ink from passing through the filter, the filter element having a circumference;

a carrier overmolded around the circumference of the filter element, such that the carrier at least partially touches every side of the filter element the carrier having a periphery configured to form a tight fluidic seal with an inkjet cartridge;

wherein the filter element polymeric material comprises an alloy of polysulfone (PSU) and polyvinylpyrrolidone (PVP) and wherein the carrier is a polyetherimide resin material.

2. An ink filter for an inkjet cartridge, comprising:

a filter element formed of a polymeric material configured to prevent particles in ink from passing through the filter, the filter element having a circumference;

a carrier overmolded around the circumference of the filter element such that the carrier at least partially touches every side of the filter element, the carrier having a periphery configured to form a tight fluidic seal with the inkjet cartridge, wherein the periphery of the carrier flexes upon seating of the carrier in the print cartridge body;

wherein the filter element has two surfaces with a backing layer adhered to at least one of the two planar surfaces.

3. The ink filter of claim 2, wherein the backing layer comprises polypropylene material.

4. A print cartridge, comprising:

a print cartridge body forming an ink chamber;

a plurality of ink ejection nozzles fluidically connected to the ink chamber;

a filter element formed of a polymeric material fluidically interposed between the ink chamber and the plurality of ink ejection nozzles, the filter element configured to prevent particles in ink from passing through the filter, the filter element having a circumference;

a carrier overmolded around the circumference of the filter element such that the carrier at least partially touches every side of the filter element, the carrier having a periphery configured to form a tight fluidic seal with the print cartridge body, wherein the periphery of the carrier flexes upon seating of the carrier in the print cartridge body.

5. The print cartridge of claim 4, wherein the filter element polymeric material comprises polysulfone (PSU).

6. The print cartridge of claim 4, wherein the filter element polymeric material comprises expanded polytetrafluoroethylene (PTFE).

7. The print cartridge of claim 4, wherein the filter element has oppositely-facing surfaces, and wherein the filter element further comprises a backing layer adhered to at least one of the oppositely-facing surfaces.

8. The print cartridge of claim 7, wherein the backing layer comprises polypropylene material.

9. The print cartridge of claim 4, wherein the periphery of the carrier comprises a resilient lip.

10. A print cartridge, comprising:

a print cartridge body forming an ink chamber;

a plurality of ink ejection nozzles fluidically connected to the ink chamber;

a filter element formed of a polymeric material fluidically interposed between the ink chamber and the plurality of ink ejection nozzles, the filter element configured to prevent particles in ink from passing through the filter, the filter element having a circumference, wherein the filter element polymeric material comprises an alloy of polysulfone (PSU) and polyvinylpyrrolidone (PVP); and a carrier overmolded around the circumference of the filter element such that the carrier at least partially touches every side of the filter element, the carrier having a periphery configured to form a tight fluidic seal with the print cartridge body.

11. A print cartridge comprising:

a print cartridge body forming an ink chamber;

a plurality of ink ejection nozzles fluidically connected to the ink chamber;

a filter element formed of a polymeric material fluidically interposed between the ink supply and the plurality of ink ejection nozzles, the filter element configured to prevent particles in ink from passing through the filter, the filter element having a circumference;

a carrier overmolded around the circumference of the filter element such that the carrier at least partially touches every side of the filter element, the carrier having a cantilever resilient lip configured to form a tight fluidic seal with the print cartridge body, wherein the cantilever resilient lip of the carrier flexes upon seating of the carrier in the print cartridge body.

12. The print cartridge of claim 11, wherein the filter element polymeric material comprises polysulfone (PSU).

13. The print cartridge of claim 11, wherein the filter element polymeric material comprises expanded polytetrafluoroethylene (PTFE).

14. The print cartridge of claim 11, wherein the filter element has two surfaces, and wherein the filter element further comprises a backing layer adhered to at least one of the two surfaces.

15. The print cartridge of claim 14, wherein the backing layer comprises polypropylene material.

16. A print cartridge comprising:

a print cartridge body forming an ink chamber;

a plurality of ink ejection nozzles fluidically connected to the ink chamber;

a filter element formed of a polymeric material fluidically interposed between the ink supply and the plurality of ink ejection nozzles, the filter element configured to prevent particles in ink from passing through the filter, the filter element having a circumference;

a carrier overmolded around the circumference of the filter element such that the carrier at least partially touches every side of the filter element, the carrier having a cantilever resilient lip configured to form a tight fluidic seal with the print cartridge body;

wherein the filter element polymeric material comprises an alloy of polysulfone (PSU) and polyvinylpyrrolidone (PVP).

17. A print cartridge comprising:

a print cartridge body forming an ink chamber;

a plurality of ink ejection nozzles fluidically connected to the ink chamber;

a filter element formed of a polymeric material fluidically interposed between the ink supply and the plurality of ink ejection nozzles, the filter element configured to prevent particles in ink from passing through the filter, the filter element having a circumference;

a carrier overmolded around the circumference of the filter element such that the carrier at least partially touches every side of the filter element, the carrier having a cantilever resilient lip configured to form a tight fluidic seal with the print cartridge body, wherein the cantilever resilient lip of the carrier flexes inwardly upon seating of the carrier in the print cartridge body.

18. An ink filter for an inkjet cartridge, comprising:

a filter element formed of an polymeric material configured to prevent particles in ink from passing through the filter, the filter element having a circumference;

a carrier overmolded around the circumference of the filter element such that the carrier at least partially touches every side of the filter element, the carrier having a periphery configured to form a tight fluidic seal with an inkjet cartridge, wherein the periphery of the carrier flexes upon seating of the carrier in the print cartridge body.

19. The ink filter of claim 18, wherein the filter element polymeric material comprises polysulfone (PSU).

20. The ink filter of claim 18, wherein the filter element polymeric material comprises expanded polytetrafluoroethylene (PTFE).

21. The ink filter of claim 18, wherein the periphery of the carrier comprises a resilient lip.

* * * * *

UNITED STATES PATENT AND TRADEMARK OFFICE

CERTIFICATE OF CORRECTION

PATENT NO. : 6,986,571 B2
APPLICATION NO. : 10/128397
DATED : January 17, 2006
INVENTOR(S) : Christie Dudenhoefer et al.

It is certified that error appears in the above-identified patent and that said Letters Patent is hereby corrected as shown below:

In column 7, line 45, in Claim 1, delete “element,” and insert -- element --, therefor.

In column 7, line 46, in Claim 1, delete “element” and insert -- element, --, therefor.

In column 9, line 9, in Claim 16, delete “fluldically” and insert -- fluidically --, therefor.

Signed and Sealed this

Fourteenth Day of July, 2009

John Doll

JOHN DOLL
*Acting Director of the United States Patent and Trademark Office*